United States Patent [19]

Simmons

[11] 4,139,157

[45] Feb. 13, 1979

[54] DUAL AIR-BLAST FUEL NOZZLE

[75] Inventor: Harold C. Simmons, Richmond Heights, Ohio

[73] Assignee: Parker-Hannifin Corporation, Cleveland, Ohio

[21] Appl. No.: 719,686

[22] Filed: Sep. 2, 1976

[51] Int. Cl.[2] ..... B05B 1/34

[52] U.S. Cl. ..... 239/400; 239/404; 239/406

[58] Field of Search ..... 239/400, 404, 405, 406, 239/443, 464; 60/39.74 A, 39.74 R, 39.74 B

[56] References Cited

U.S. PATENT DOCUMENTS

| | | | |
|---|---|---|---|
| 2,551,276 | 5/1951 | McMahan | 239/400 |
| 2,701,164 | 2/1955 | Purchas, Jr. et al. | 239/404 X |
| 2,703,260 | 3/1955 | Olson et al. | 239/404 |
| 2,959,003 | 11/1960 | Carlisle et al. | 60/39.74 B |
| 3,474,970 | 10/1969 | Simmons et al. | 239/406 X |
| 3,520,480 | 7/1970 | Halvorsen | 239/404 |
| 3,684,186 | 8/1972 | Helmrich | 239/400 X |
| 3,912,164 | 10/1975 | LeFebvre et al. | 239/400 X |
| 3,980,233 | 9/1976 | Simmons et al. | 239/400 |

FOREIGN PATENT DOCUMENTS

| | | | |
|---|---|---|---|
| 857038 | 12/1960 | United Kingdom | 239/404 |

*Primary Examiner*—John J. Love

*Attorney, Agent, or Firm*—Maky, Renner, Otto & Boisselle

[57] ABSTRACT

In a nozzle for atomizing fuel into a spray for combustion in gas turbine engines, wherein the atomization is effected by the use of high velocity and/or high density air, and wherein the supply of fuel to two separately metered points is such that at low flow rates the first fuel supply is spread into a thin sheet for atomization but at high flow rates the second fuel supply is spread into a thicker sheet which combines with the thin sheet produced from the first supply, thus resulting in a single spray of constant shape at all operating conditions.

2 Claims, 6 Drawing Figures

DUAL AIR-BLAST FUEL NOZZLE

BACKGROUND OF THE INVENTION

The achievement of satisfactory combustion of the fuel in a gas turbine engine has always presented problems. As a minimum requirement it is essential for the fuel to be atomized into a spray of small drops at all operating conditions and to obtain this result over the wide range of fuel flows necessary (typically maximum/minimum = 100) has required the development of complex and sophisticated fuel spray nozzles. It is well known to use swirl-atomizers in which the fuel is supplied at high pressure to a swirl-chamber in which a free vortex is formed so that the fuel issues from the discharge orifice of the swirl-chamber as a thin sheet of conical shape which breaks up into a spray of drops by interaction with the surrounding air; these are known conventionally as "pressure atomizers". Since a pressure atomizer can only produce a satisfactory spray over a flow range of about 7:1 (maximum:minimum) it has been necessary to combine two pressure atomizers, one of low flow capacity known as a "pilot" or "primary" and the other of high flow capacity, known as a "secondary", into a single fuel nozzle such as is disclosed in U.S. Pat. No. 3,013,732 which is conventionally known as a "dual orifice" nozzle.

To obtain improved atomization compared with the pressure atomizer it is well known to use high velocity and/or high pressure air as the means of atomizing the fuel, as disclosed in U.S. Pat. No. 3,474,970 and No. 3,283,502. In the former the air is supplied from a source external to the engine and the nozzle is known as an "air-assisted" type. In the latter the air is available inside the engine and this is known as an "air-blast" type. Although the fuel flow range for satisfactory atomization of both "air-assist" and "air-blast" types is greater than a single "pressure atomizer" there are many applications in which it is considered necessary or desirable to combine an air-atomizing nozzle with a pressure atomizer as is disclosed in U.S. Pat. No. 3,912,164. In such an arrangement the pressure atomizer is used for the low fuel flow rate conditions, such as starting the engine, while the air-atomizer is used for the higher fuel flow rates, and this combination is usually described as a "hybrid" type.

With both the dual-orifice and hybrid types of nozzle it is the invariable practice to maintain the "pilot" or "primary" nozzle flowing at all times so that at the higher fuel flows the primary and secondary atomizers are both in operation. There are some disadvantages in this arrangement since the shape of the primary spray is often different from that of the secondary spray and can result in a non-optimum placement of fuel in the combustion chamber. For example, if the primary spray angle is less than the secondary (which may be desirable to obtain good starting) then at high power conditions when the secondary also is in operation, the primary fuel may be concentrated in the center of the total spray and this produces smoke in the engine exhaust. The obvious solution to this problem is to shut off the primary nozzle fuel flow at high power conditions but this has been found to be impractical since the residue of fuel left in the primary nozzle readily carbonizes at the high metal temperatures prevalent at these operating conditions and the primary nozzle fuel flow passages can become plugged with carbon. A compromise solution is to reduce the primary fuel flow after the secondary fuel flow has reached a certain value, as disclosed in U.S. Pat. No. 3,675,853, but this requires the use of additional valve means located in the hottest operating environment, which is not conducive to the high reliability of operation demanded.

Ideally, therefore, what is needed is a fuel nozzle, having all the known advantages of an air-atomizer and also the wide flow range capability of a hybrid design, in which the spray from the primary ceases to exist as a separate entity when the secondary is in operation.

SUMMARY OF THE INVENTION

The present invention consists of an air-blast nozzle having a "primary" and "secondary" fuel supply (as defined previously) in which the primary fuel is spread into a thin cylindrical or conical sheet to be atomized by high velocity and/or high pressure air. The secondary fuel is also spread into a coaxial cylindrical or conical sheet, of greater thickness than the primary, and the relationship of the two sheets of fuel is such that the secondary sheet combines with the primary sheet before being acted upon by the atomizing air. The objects of the invention are thus to (a) Obtain the benefits of having a separate primary fuel supply including improved atomization at low fuel flows;

(b) To eliminate the existence of a separate primary spray once the secondary fuel flow has commenced;

(c) To insure the production of a single spray of known shape at all operating conditions; and (d) To allow fuel to flow continuously through the primary flow passages at all operating conditions.

Other objects and advantages will become apparent from the description of various embodiments of the invention.

This invention may be incorporated into air-blast fuel nozzles as disclosed in U.S. Pat. No. 3,912,614 and in the copendng U.S. Application Ser. No. 634,460 filed Nov. 24, 1975, now U.S. Pat. No. 3,980,233 dated Sept. 14, 1976.

DESCRIPTION OF INVENTION

Figure 1:
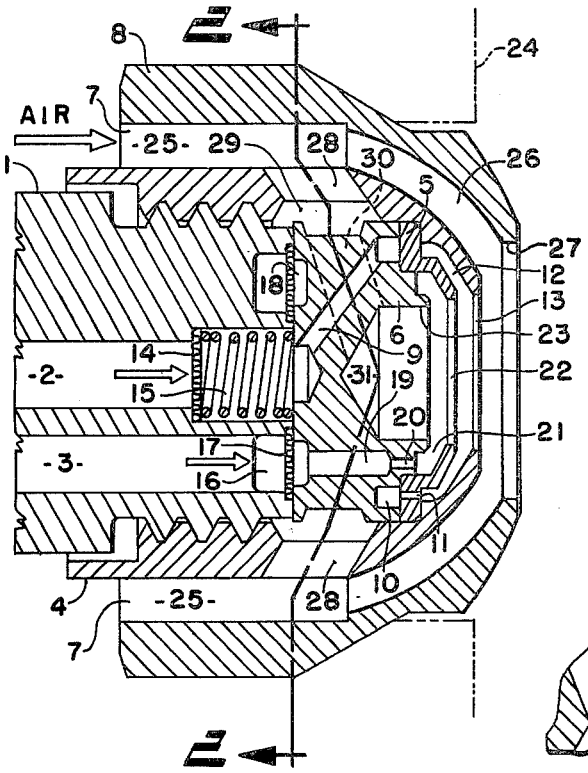
FIG. 1 is a diametrical longitudinal cross-section view of a nozzle according to the present invention.
Figure 2:
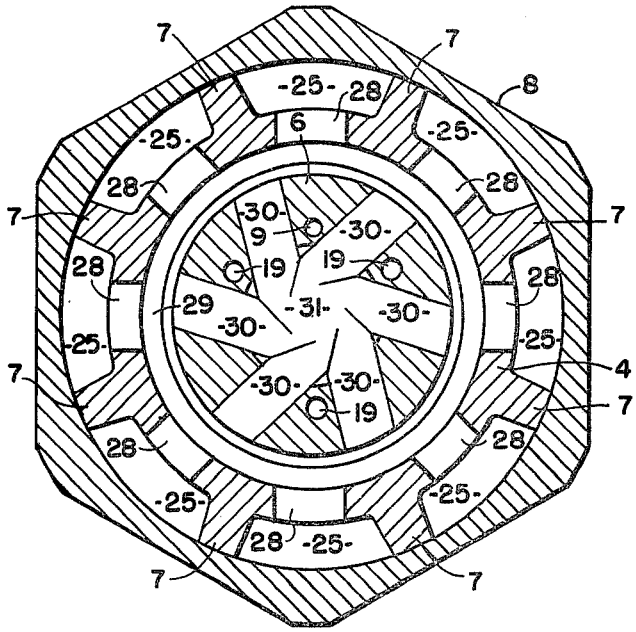
FIG. 2 is a transverse cross-section view along line 2—2, FIG. 1.

The general arrangement of one embodiment of the invention is shown in FIGS. 1 and 2 in longitudinal and transverse section. A mounting member 1 has drilled passages 2 and 3 for primary and secondary fuel respectively. A primary nozzle body 4 is threaded onto mounting member 1 to contain a secondary nozzle 5 and transition piece 6 in sealing contact. Body 4 has vanes 7 formed on its outer surface to which is attached by brazing or welding a shroud 8 formed externally as a hexagonal nut for wrenching. Torque is applied at assembly of the nozzle to shroud 8 and body 4 to insure sufficient axial load between the joint faces of parts 1, 6, 5 and 4 to prevent leakage of fuel from these joints. The body 4 is locked to the member 1 by conventional means not shown.

The path of the primary fuel is as follows: starting at the drilled passage 2 it passes through a filter screen 14 which is held in place by spring 15 into passage 9 which feeds an annulus 10. Four angled spin holes 11 take the primary fuel from annulus 10 into the spin or swirl chamber 12 formed by parts 4 and 5 to create a free vortex which discharges, as is well known, over the lip 13 of part 4 in a thin sheet of expanding conical shape, as will be described in greater detail later.

Figure 3:
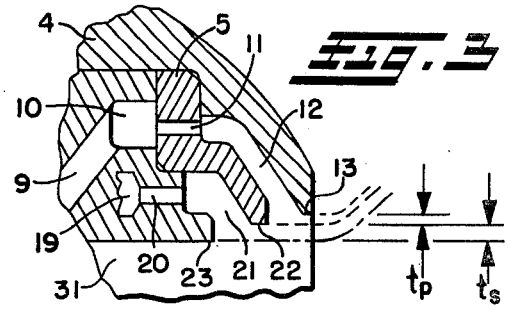
FIGS. 3 and 4 are enlarged fragmentary radial cross-section views of the FIG. 1 nozzle.

The secondary fuel, starting at the drilled passage 3, is fed into an annulus 16, passes through a filter screen 17 into a second annulus 18 and then through three drilled passages 19 each of which terminates in an angled spin hole 20. The spin holes lead into the spin or swirl chamber 21 formed by parts 5 and 6 to create a free vortex which discharges over the lip 22 of part 5 as a sheet of fuel which combines with the fuel sheet from the primary swirl chamber to form a single sheet leaving lip 13. The combination process is shown pictorially in FIG. 3 which is an enlarged view of a portion of FIG. 1. It will be noted that the lips 23, 22 and 13 are placed at progressively increasing radii from the axis of the nozzle and are dimensioned so that the fuel in the primary swirl chamber 12 can flow only past the lip 13 in a downstream direction relative to the air flow. Similarly, the fuel in the secondary swirl chamber 21 can flow past the lip 22. The difference in radius between the lips 13 and 22 is designed to be only slightly greater than the thickness of the primary sheet indicated in FIG. 3 as $t_p$, thus the secondary sheet of thickness $t_s$ will blend smoothly into the primary sheet just downstream of lip 22 giving a single sheet of fuel leaving lip 13 to be atomized by the air as will be described later. The difference in radii between lips 22 and 23 is not critical as long as it is greater than the secondary sheet thickness $t_s$. The direction of swirl in chambers 12 and 21 will usually be the same but this is not essential to the invention.

Returning to FIG. 1, the path of the air which atomizes the fuel sheet leaving lip 13 can now be described. It will be understood that fuel nozzles are typically installed in an engine so that the nozzle protrudes through the wall of the combustion chamber, a portion of which is indicated by the broken lines 24 and that there exists under all operating conditions a difference in air pressure between the outside and inside of said combustion chamber which causes air to flow through any passage communicating therebetween. Accordingly, air will flow through the passages 25 between parts 4 and 8 in a direction determined by vanes 7, which may be axial or angled to the axis or helical in order to produce either straight or swirling flow in the annular passage 26 to exit within the region of the lip 27. A portion of the air will also flow through the holes 28 into annulus 29 and then through the passages 30 into the center region denoted as 31. The passages 30 are shown as being tangentially disposed rather than radially so as to produce a swirling air flow in the center region 31 although this feature is not an essential part of the invention. The direction of swirl (if any) in either of regions 27 and 31 may be the same or different with respect to each other and also to the direction of the fuel swirl.

Figure 4:
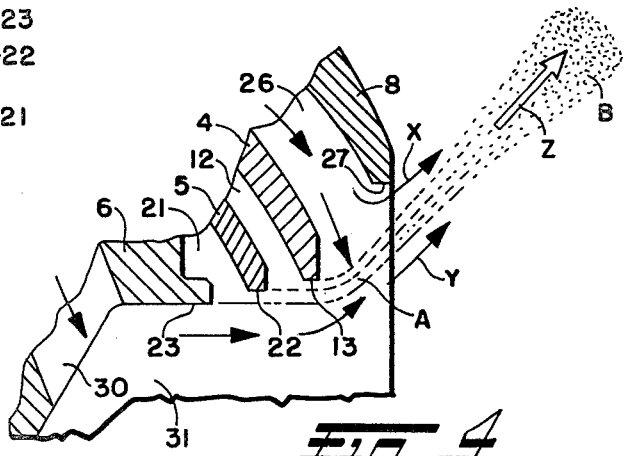

The action of the air on the fuel sheet is shown in FIG. 4 which is a diagrammatic section of the inner portion of the fuel nozzle. In this case we show the air flow directions when both inner and outer air flows are swirled. It is seen that the high velocity air streams converge on the fuel sheet at the point A immediately downstream of the lip 13 to cause break-up of the sheet and the production of an atomized spray as indicated at B. The arrow X is intended to represent the direction of the outer air flow which is actually moving in a swirling manner inside lip 27 to form an expanding cone in three dimensions; arrow Y is similarly representative of the inner air flow. The arrow Z shows the general direction of the fuel spray resulting from the air flow. It is evident that the direction of arrow Z will be the same whether the fuel sheet consists only of primary flow or combined primary and secondary flow; in other words the spray shape will be essentially constant at all conditions.

It is obvious that the air for atomizing can be supplied from a source outside the engine, if necessary, by suitable connections to the passages 25.

The invention is not limited to the particular arrangement of air passages inside the fuel nozzle shown in FIG. 1 except that the final points of exit of air from the nozzle must be at two regions, one on either side of the fuel sheet, in the same relation to the fuel sheet as the regions indicated as 27 and 31 in FIG. 1. In particular, the air supplied to the center of the nozzle may be introduced in an axial direction through the mounting member in known manner.

Figure 5:
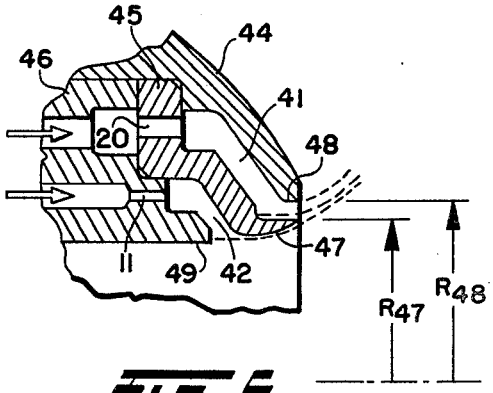
FIGS. 5 and 6 are enlarged fragmentary radial cross-section views of other forms of nozzles embodying the present invention.

Other geometric arrangements of the invention are possible for particular purposes. For example, there may be installations which require that the secondary swirl chamber shall be outside the primary swirl chamber, i.e. the secondary fuel sheet is outside the primary fuel sheet before combining into a single sheet. Such an arrangement is shown in FIG. 5 where parts 44, 45 and 46 are similar to parts 4, 5 and 6 of FIG. 1 except that the radial disposition of the primary and secondary inlet passages and swirl chambers is reversed, making the secondary swirl chamber 41 and the primary swirl chamber 42 as shown. In order to insure that the primary fuel sheet is exposed to the outer atomizing air with the least interference from the secondary lip 48 the primary lip 47 is extended as shown and curved outward so that its downstream edge is in essentially the same plane as the downstream edge of lip 48. The difference between the radius ($R_{48}$) of the inner surface of lip 48 and the radius ($R_{47}$) of the outer surface of lip 47 is designed to be only slightly greater than the thickness ($t_s$) of the secondary sheet, thus the two sheets will combine smoothly at a point only slightly downstream of the lips 47 and 48. The difference in radii between the upstream corner of lip 47 and lip 49 is not critical as long as it is greater than the primary thickness $t_p$.

Figure 6:
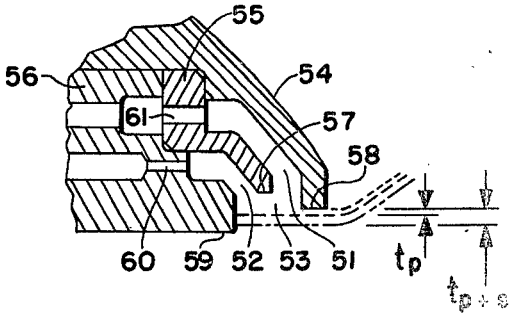

Another geometric arrangement of the invention is shown in FIG. 6. In this case the objective of producing a single fuel sheet from two fuel supply sources is achieved by mixing the primary and secondary fuel flows in a common swirl chamber with a single discharge lip. Parts 54, 55 and 56 are arranged similarly to FIG. 5 to form primary and secondary swirl chambers 52 and 51 respectively both of which feed into a common chamber 53, which discharges at lip 58. The lip 57 of part 55 is at a larger radius than lip 58; lip 59 of part 56 is at a smaller radius than lip 58 the difference in radii being slightly greater than the fuel sheet thickness, as shown. In operation on primary fuel only the fuel in chambers 52 and 53 is swirled by the primary spin holes 60 to form a sheet of thickness $t_p$ at the lip 58. When secondary fuel is added through angled holes 61 it is swirled in chamber 51 and the chamber 53 then acts as a mixing chamber in which the momenta of the primary and secondary fuel are combined (the direction of swirl being the same for primary and secondary). The combined fuel then discharges at the lip 58 in a single sheet of thickness $t_{p+s}$ to be atomized by air as described previously.

It will be understood that the fuel system feeding the nozzles contains valves of known type which permit fuel to be fed first to the primary passages and then, at a higher operating condition to both primary and secondary in desired proportionate flow rates.

One advantage of employing the invention to produce a thinner fuel sheet (from the primary) at low fuel flows is that, in general, the fineness of the spray is directly related to the thickness of the fuel sheet at the point of break-up into drops. The fineness of a spray is expressed conventionally by the use of the well known "Sauter Mean Diameter" or SMD, which is the diameter of a hypothetical spherical drop having the same surface-to-volume ratio as the entire spray, and it has been established by tests that the SMD varies proportionately to a fractional power of the fuel sheet thickness, all other things being equal. Expressed mathematically:

$$SMD \propto t^n \quad (1)$$

where SMD = Sauter Mean Diameter t = fuel sheet thickness at break-up into drops.

n = 0.375 approximately.

It can readily be calculated, and is well known, that the fuel sheet thickness is directly related to the flow capacity of a swirl-atomizer such that a lower flow capacity atomizer gives a thinner sheet. It is common for a "primary" nozzle to have a flow capacity only 1/10th of a "secondary" nozzle in a combined arrangement and thus its fuel sheet thickness $t_p$ will be only 1/10 approximately of the secondary fuel sheet thickness $t_s$, i.e. $t_p/t_s = 0.1$.

The corresponding SMD's can be calculated from equation (1) to be $$(\text{SMD primary})/(\text{SMD secondary}) = 0.1\ 0.375 = 0.42$$

In other words, at a given operating condition (of fuel flow rate, air velocity and pressure etc.), the primary atomizer will give a spray having a mean drop diameter 58% smaller than the secondary atomizer. This difference in fineness of the spray may well make it possible to start and run an engine on "primary" where it would be impossible to start with an atomizer having the flow characteristics of a "secondary" only.

It will be understood that there is no limitation on the flow capacities of either "primary" or "secondary" in the invention here described, or their relation to each other.

Other embodiments of the invention may make use of fuel and air swirl-producing devices such as slots, cast passages etc. in cylindrical, conical or radial planes as is well known in the art.

The embodiments of the invention in which an exclusive property or privilege is claimed are defined as follows:

1. An air-atomizing fuel nozzle comprising a nozzle body assembly defining therewithin primary and secondary fuel passages including respective coaxial radially and axially outer and inner primary and secondary vortex chambers to impart a whirling motion to the fuel flowing through said passages for discharge from said vortex chambers in the form of a conical sheet of radial thickness representing the conjoint flow through said primary and secondary passages, said body assembly having central and annular air passages from which air is discharged respectively interiorly and exteriorly of said conical fuel sheet to atomize the conical fuel sheet whether of thickness corresponding to the flow through said primary vortex chamber alone or of thickness corresponding to the sum of the flows through said primary and secondary vortex chambers, said primary and secondary vortex chambers terminating in axially spaced-apart primary and secondary discharge orifices of which said primary discharge orifice is downstream of said secondary discharge orifice; said primary discharge orifice being of larger diameter than said secondary discharge orifice by an amount approximately equal to twice the radial thickness of the fuel emerging from said primary discharge orifice.

2. The nozzle of claim 1 wherein said central air passage terminates upstream of said secondary discharge orifice and is of diameter no greater than the diameter of said secondary orifice minus twice the thickness of the fuel emerging from said secondary discharge orifice; said body assembly having a transition piece with radially inwardly extending passages intercommunicating an upstream portion of said annular air passage with said central air passage; said transition piece having primary and secondary fuel passages upstream of the respective vortex chambers and circumferentially offset from said radially inwardly extending passages.

* * * * *